US005236041A

United States Patent [19]

Fay

[11] Patent Number: 5,236,041

[45] Date of Patent: Aug. 17, 1993

[54] CYCLONIC VAPOR FLOW CONDENSER

[75] Inventor: John M. Fay, Warminster, Pa.

[73] Assignee: Hull Corporation, Hatboro, Pa.

[21] Appl. No.: 733,526

[22] Filed: Jul. 22, 1991

[51] Int. Cl.[5] ..... F26B 5/06; F26B 13/24

[52] U.S. Cl. ..... 165/47; 165/111; 34/5; 34/92; 62/55.5; 62/268

[58] Field of Search ..... 62/55.5; 165/47, 111, 165/114, 110; 34/5, 92

[56] References Cited

U.S. PATENT DOCUMENTS

| | | | |
|---|---|---|---|
| 2,455,059 | 11/1948 | Hickman | 165/111 |
| 3,077,036 | 2/1963 | Neumann | 34/92 |
| 3,132,930 | 5/1964 | Abbott et al. | 34/5 |
| 3,365,806 | 1/1968 | Pfluger et al. | 34/5 |
| 3,381,746 | 5/1968 | Wiegmann et al. | 165/111 |
| 3,579,998 | 5/1971 | Thibault | 62/55.5 |
| 3,648,473 | 3/1972 | Stephenson | 62/55.5 |
| 4,353,222 | 10/1982 | Kobayashi | 62/268 |
| 4,407,140 | 10/1983 | Kobayashi | 34/92 |
| 4,407.488 | 10/1983 | Wanetzky et al. | 266/148 |
| 4,949,473 | 8/1990 | Steinkamp | 34/5 |
| 5,029,640 | 7/1991 | Niggemann | 165/111 |

*Primary Examiner*—John K. Ford

*Attorney, Agent, or Firm*—Olson & Olson

[57] ABSTRACT

A condenser for removing vapor from freeze dryers and other vessels includes a three-stage cyclonic or turbine-like vapor distributor mounted for rotation about the axis of an elongated horizontal delivery tube extending through the axial center of the condenser chamber. The delivery tube mounts end and radial spray nozzles for selectively spraying cleansing fluid and sterilizing steam onto the interior surfaces of all components within the condenser chamber, including a plurality of condenser members arranged in radially offset configuration about the delivery tube in an optically dense configuration which requires vapors to impact the cold surfaces of the condenser members before contacting the inner surface of the enclosing condenser chamber. Optical density is achieved by providing the condenser member as sheets of metal formed with a serpentine passageway between them for the circulation of a coolant. Alternatively, optical density may be achieved by providing the condenser member as metal tubing bent in serpentine shape with open spaces between the bent sections, and enclosing the array of tubular condenser members in a cylindrical wall spaced inwardly from the condenser chamber.

19 Claims, 6 Drawing Sheets

CYCLONIC VAPOR FLOW CONDENSER

BACKGROUND OF THE INVENTION

This invention relates to lyophilization, and more particularly to a novel condenser for removing vapor from freeze dryers and other vessels.

Condensers have been provided heretofore for the foregoing purpose. Representative of these are the condensers disclosed in U.S. Pat. Nos. 3,381,746; 4,353,222; 4,407,140; 4,407,488; and 4,949,473. These are characterized generally by high cost of manufacture and operation, and relatively inefficient sublimation.

SUMMARY OF THE INVENTION

The condenser of this invention includes an adjustable multi-stage cyclonic distributor which directs vapor flow from a sublimation or other vessel over a plurality of circumferentially spaced condenser plates which are disposed in a generally radial but tangentially offset relation and arranged to require the vapor flow to impact the cold surfaces of the condenser plates as the vapor flow progresses radially outward to the inner surface of the condenser vessel. A delivery tube extends through the axial center of the vessel and is provided with axially spaced nozzles for spraying the interior of the vessel and the surfaces of the condenser plates selectively with cleaning fluid and with sterilizing steam.

It is the principal objective of this invention to provide a condenser of the class described which overcomes the aforementioned limitations and disadvantages of prior condensers.

Another objective of this invention is to provide a condenser of the class described which includes an arrangement of condenser plates that affords maximum efficiency of vapor condensation.

Still another objective of this invention is to provide a condenser of the class described which affords cleaning and sterilizing of the condenser chamber and condenser plates by use of a single delivery tube for cleaning fluid and sterilizing steam and a minimum number of distribution nozzles.

A further objective of this invention is the provision of a condenser of the class described which includes an arrangement of condenser plates which requires all vapor flow to contact the cold condenser plates on the way to the vacuum source and prevents backflow of vapor from the vacuum source without first contacting a cold condenser plate.

A still further objective of this invention is the provision of a condenser of the class described which is of simplified construction for economical manufacture, operation, maintenance and repair.

The foregoing and other objects and advantages of this invention will appear from the following detailed description, taken in connection with the accompanying drawings of a preferred embodiment.

DESCRIPTION OF THE PREFERRED EMBODIMENTS

Figure 1:
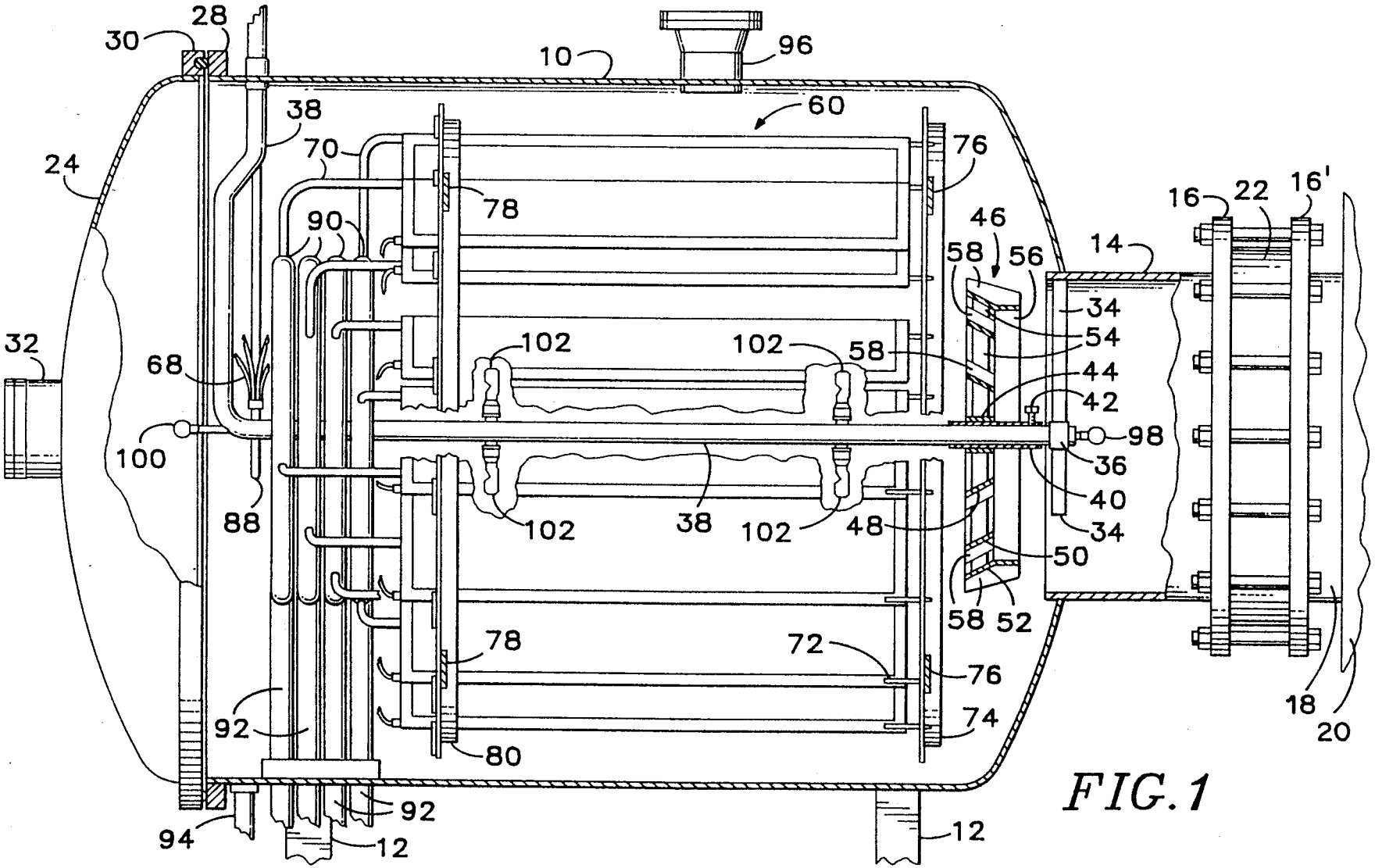
FIG. 1 is a side elevation of a condenser embodying the features of this invention, portions being broken away to disclose details of internal construction.
Figure 2:
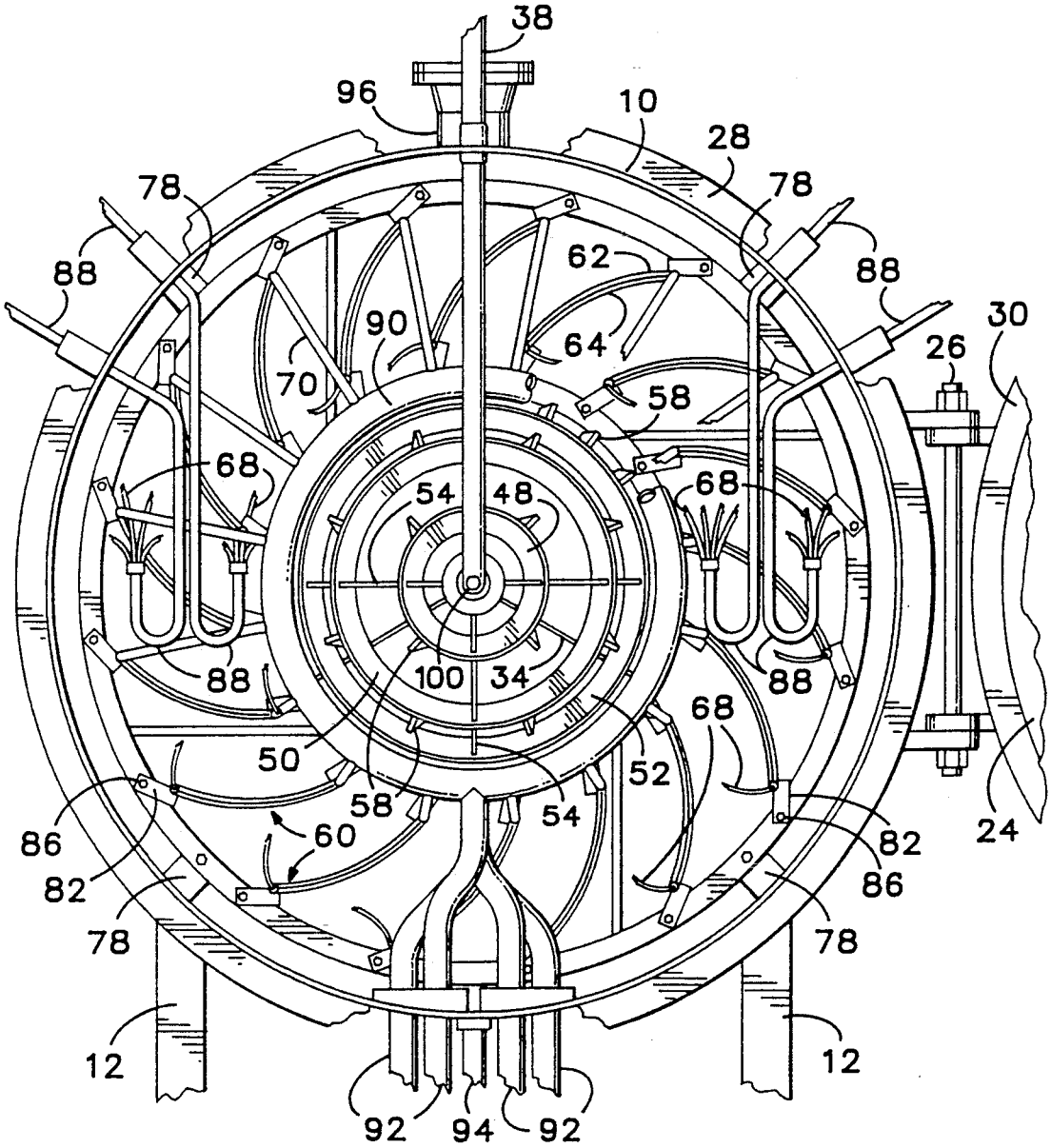
FIG. 2 is an end view of the condenser as viewed from the left in FIG. 1 with the closure door opened to expose the structural arrangement within the condenser chamber.

The condenser illustrated In FIGS. 1 and 2 includes a horizontal cylindrical chamber 10 supported on laterally and longitudinally spaced legs 12 and provided at the front end with a tubular vapor inlet duct 14. An annular flange 16 on the outer end of the inlet duct is configured for coupling to a corresponding flange 16, on the vapor outlet duct 18 of a freeze dryer or other vessel 20 with a control closure valve 22 interposed between the flanges. The opposite, rear end of the chamber 10 is removably closed by an access door 24 mounted on hinge shaft 26 supported by the chamber. Sealing rings 28 and 30 on the chamber 10 and door 24, respectively, provide a pressure and vacuum seal. A sight window 32 in the door affords visual inspection of the interior of the chamber.

Adjacent the inner end of the inlet duct 14 a framework of radial bars 34 supports a hollow hub 36 which, in turn, supports the forward end of an elongated cleansing and sterilizing tube 38 described in detail hereinafter. The tube freely receives a mounting sleeve 40 for rotational and longitudinal adjustment on the tube. A set screw 42 on the sleeve serves to secure the sleeve in desired adjustment. The sleeve is secured, as by welding, to the hollow hub 44 of a three stage cyclonic or turbine-like vapor distributor 46.

The distributor 46 includes three concentric spaced rings 48, 50, 52 secured together by radial arms 54. These rings flare in the forward direction toward the interior of the chamber 10 and are spaced apart appropriately to direct vapor flow from the sublimation vessel 20 radially outward into the chamber 10. The outer ring 52 includes a cylindrical splitter ring 56 for directing an inner portion of the vapor from vessel 20 into the concentric rings and an outer portion outwardly of ring 52.

Turbine-like blades or fins 58 are secured to and project radially inward from rings 48 and 50 and radially outward from rings 52, 56 at a slight angle relative to the axial direction of the chamber 10. The flow of vapor through and around the distributor thus impacts the arms and is caused to take a rotational path through the chamber, into contact with a plurality of condenser members 60.

Each of the condenser members 60 is formed of a pair of metal plates 62 and 64 sealed together about their peripheries and arranged in spaced apart relationship. One or both plates are configured to provide an interior serpentine passageway 66 for the circulation of refrigerant, brine, or other form of coolant from an infeed tube 68 to an outfeed tube 70.

A pair of mounting pins 72 project longitudinally from the rear corners of each condenser member 60 for mounting in cooperating openings in a support ring 74. The support ring is secured within the chamber 10, adjacent the rings of the cyclonic distributor 46, by a plurality of circumferentially spaced blocks 76. Similar spacer blocks 78 secure a second support ring 80 in the chamber 10 for supporting the opposite end of each condenser member. This is achieved by means of a pair of brackets 82 and 84 which extend laterally from the opposite sides of the condenser member and are secured to the support ring 80, as by bolts 86.

The infeed tubes 68 are connected in groups to infeed pipes 88 which communicate selectively with a source of refrigerant and a source of brine (not shown). The outfeed tubes 70 are connected in groups through annular manifolds 90 to discharge headers 92 which return brine to a cooling system and return refrigerant vapors to the compressor component of a refrigeration system.

A drain pipe 94 in the bottom side of the chamber serves to exhaust condensed vapors and other liquids from the chamber after the sublimation and defrost functions have been completed. A vent pipe 96 in the upper side of the chamber allows non-condensible vapors to exhaust through a vacuum system to the atmosphere.

In the embodiment illustrated, means is provided for cleaning and sterilizing the interior surfaces of the chamber 10, the condenser member 60 and associated components, with speed and facility. Thus, the elongated delivery tube 38 mentioned hereinbefore extends through the axial center of the chamber 10 and through the annular outfeed manifolds 90. The tube then extends radially upward through the cylindrical wall of the chamber 10 for selective communication through control valves (not shown) with sources of cleansing fluid and sterilizing steam.

Figure 4:
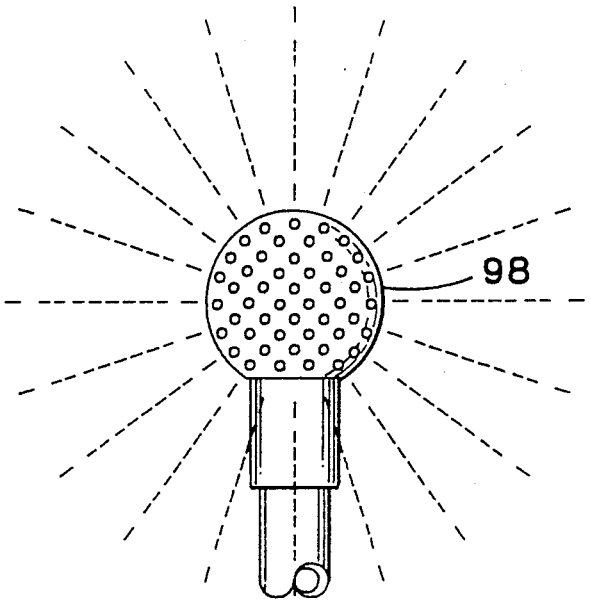
FIG. 4 is a detail view of one of the nozzles at the opposite ends of the cleaning and sterilizing delivery tube.

Spray nozzle 98 communicates with the front end of the tube 38, while nozzle 100 communicates with the rear end of the axial portion of the tube, i.e. at the bend where the axial portion joins the radial portion. These nozzles 98 and 100 are of the type that provide a spray of substantially spherical shape, as illustrated in FIG. 4.

Figure 5:
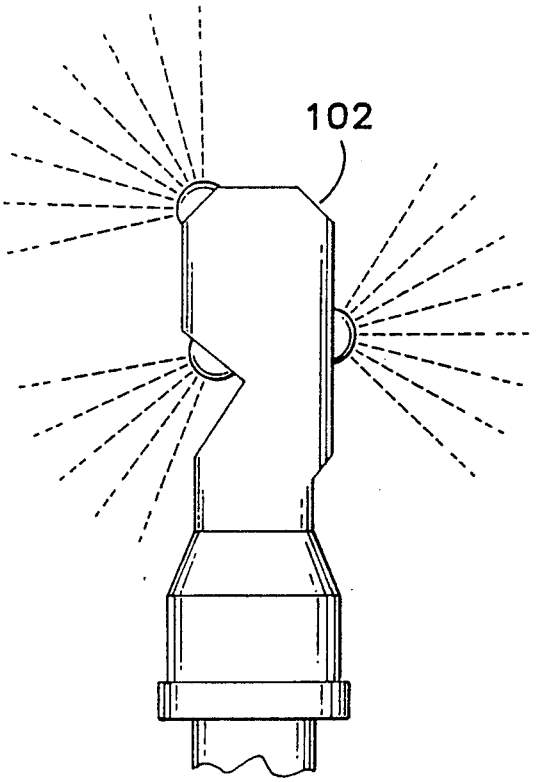
FIG. 5 is a detail view of one of the nozzles located intermediate the ends of the cleaning and sterilizing delivery tube.

Spray nozzles 102 communicate with intermediate portions of the horizontal section of the tube 38 and extend laterally therefrom in diametrically opposed pairs. As shown in FIG. 5, these nozzles also provide a spray of substantially spherical shape for directing spray onto the surfaces of the condenser plates 60.

As best shown in FIG. 2, the condenser members 60 are curved arcuately across their width and supported by the rings 74 and 80 in a circumferentially spaced apart configuration providing optical density to the flow path of vapor from the sublimation vessel 20. By optical density is meant that the condenser members 60 are disposed in a generally radial but tangentially offset relation such that radial lines or planes extending outwardly from the longitudinal axis of the tube 38, and hence the chamber 10, between adjacent condenser members, intercept a condenser member before they reach the inner surface of the chamber 10. This arrangement insures that the condensible vapors of the vapor flow come into intimate contact with and adhere to the cold surfaces of the condenser plates 62 and 64, and the non-condensible vapors pass freely outward through the passages between condenser members and thence through the exhaust outlet 96 which is connected to a vacuum system from whence they are discharged to the atmosphere.

The optical density configuration of the condenser members also serves to collect any back-streaming products from the vacuum system which otherwise might contaminate the product being processed in the sublimation vessel 20.

In operation, vapor flow generated by the coupled sublimation vessel 20 is introduced through the vapor inlet pipe 14. This vapor flow passes through the adjustable three-stage cyclonic or turbine-like distributor 46, resulting in distribution of the vapor flow stream in proportion to the condenser member surfaces. The turbine-like blades 58 on the distributor also effects swirling of the vapor flow which directs the vapor efficiently onto the condenser members. Longitudinal and/or rotational adjustment of the distributor maximizes the contact of vapor onto the condenser members.

The surfaces of the condenser member sheets 62 and 64 are chilled by direct expansion refrigeration, or by circulation of a suitable cold brine through the serpentine passageways 66.

Arrangement of the surfaces of the condenser members radially about the horizontal axis of the chamber 10 and perpendicular to the flow stream, produced by the distributor, assures even distribution of the vapor flow over the condenser members. This correspondingly maximizes efficiency of the refrigeration system.

The optically dense configuration of the condenser member assembly prevents vapor flow toward the discharge outlet 96 without first contacting the condenser members, surfaces. It also prevents backflow or back-streaming of vapor from the vacuum system without first impacting the cold condenser members. This is critical to sterile processing, and has not been provided heretofore.

Operation of the cleansing and sterilizing systems is achieved by first delivering steam under pressure through a control valve to the delivery tube 38. The steam is sprayed through the nozzles 98, 100 and 102 onto the surfaces of the condenser members 60 to defrost the ice that has collected on the members. Then, cleansing fluid under pressure is delivered through the nozzles onto the surfaces of the condenser plates 62 and 64, the interior surface of the chamber 10 and door 24, and the exposed surfaces of the associated components within the chamber. Cleansing fluid is drained from the chamber through drain pipe 94. Thereafter, steam is delivered through the tube 38 and spray nozzles to sterilize the exposed surfaces of all components within the chamber.

The condenser described hereinbefore provides maximum efficiency of sublimation by even distribution of vapor and total condenser surface loading. This is due in part to the optical density configuration of the condenser members 60, which also disallows flow of back-streaming constituents through the condensing surfaces. The multiple function of delivery tube 38 in delivering defrost steam, cleansing fluids and sterilizing steam effectively reduces the number of spray nozzles required for thorough cleaning and sterilizing of all interior surfaces because of the efficient distribution of the fluids over the exposed surfaces. The delivery tube 38 also performs the additional function of rotatably supporting the conical three-stage distributor 46 while allowing maximum adjustment along the tube 38.

Figure 3:
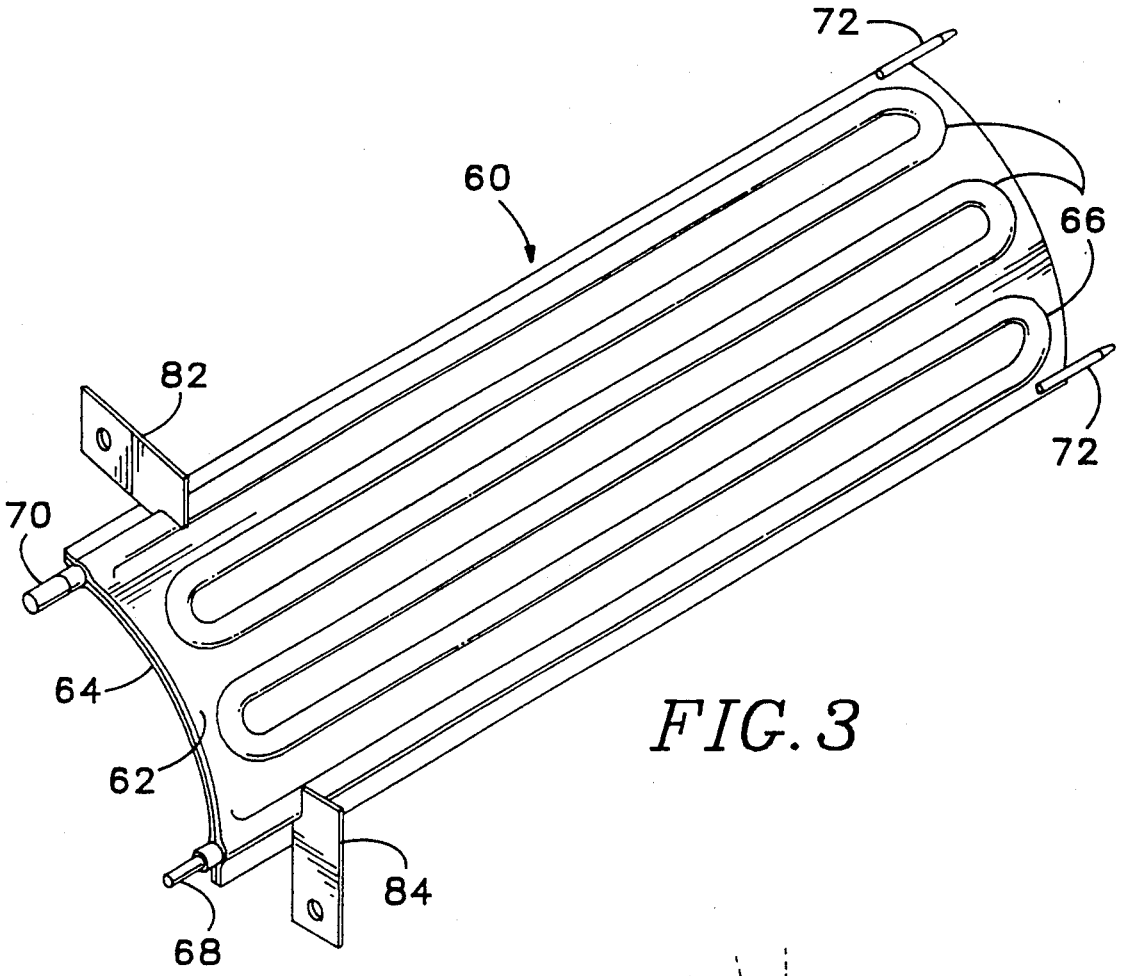
FIG. 3 is a perspective view of one of the condenser plates of the condenser shown in FIGS. 1 and 2.
Figure 6:
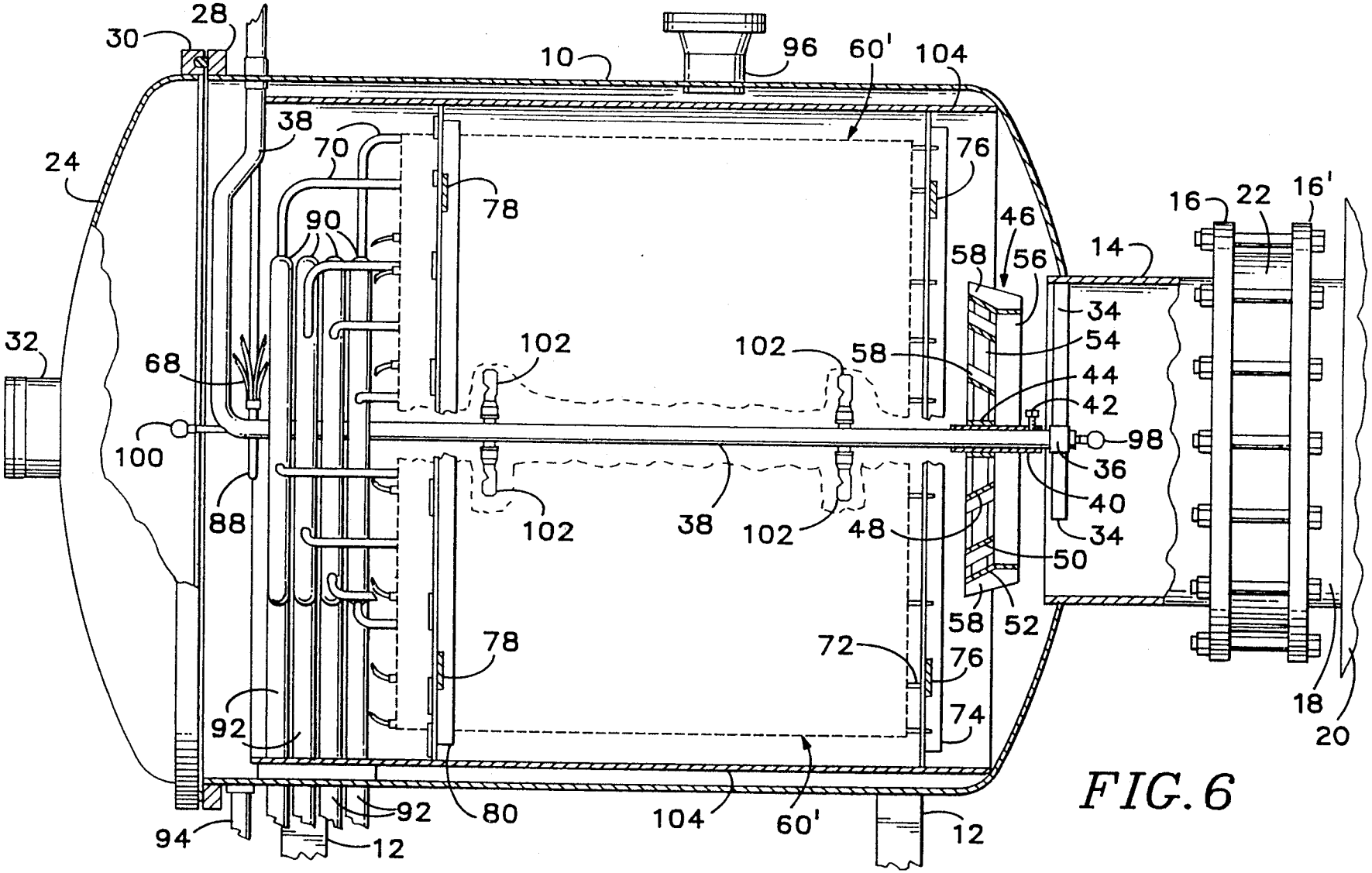
FIG. 6 is a side elevation, similar to FIG. 1, of a second embodiment of a condenser embodying the features of this invention.
Figure 7:
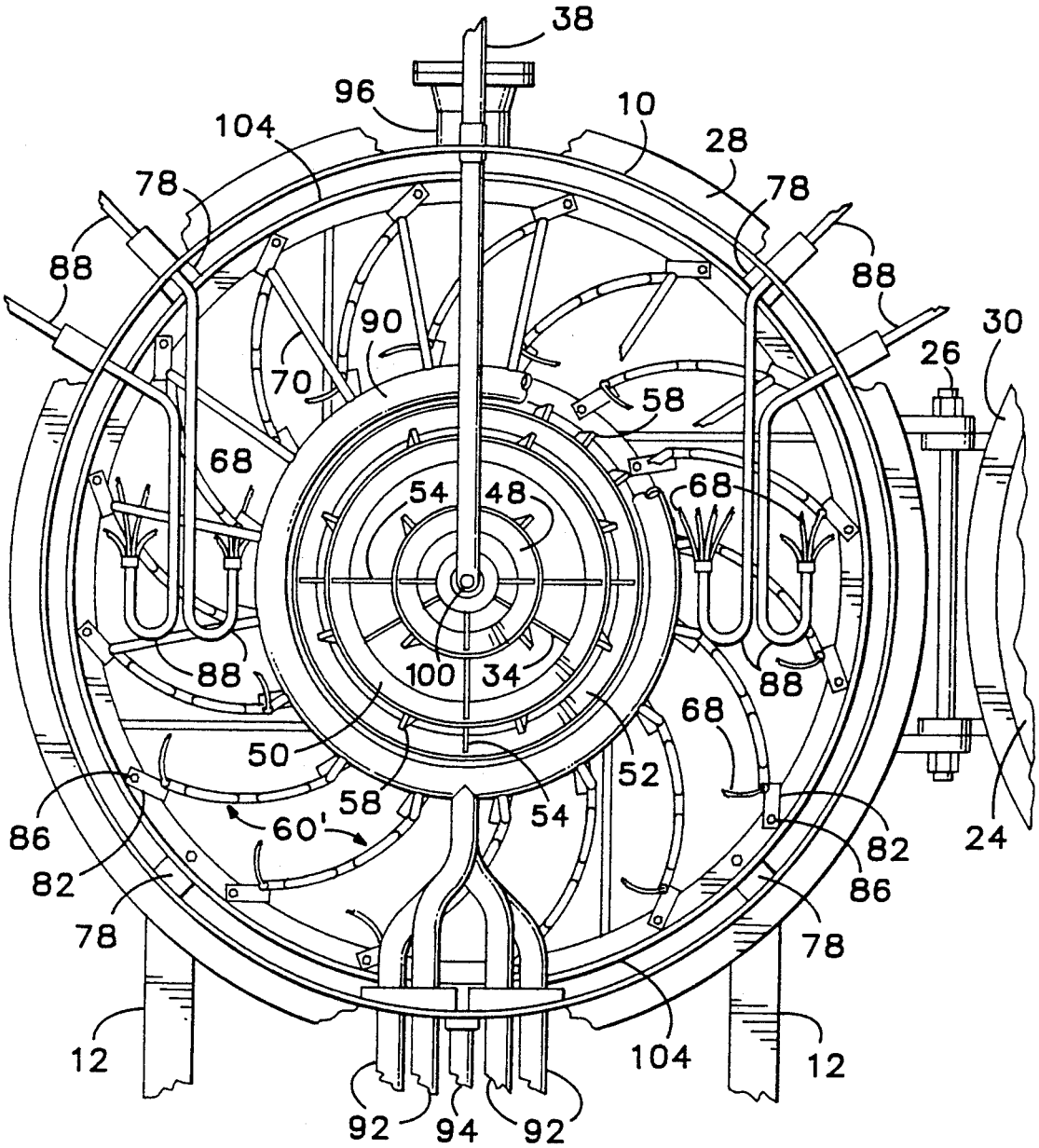
FIG. 7 is an end view, similar to FIG. 2, of the condenser as viewed from the left in FIG. 6 with the closure door opened.
Figure 8:
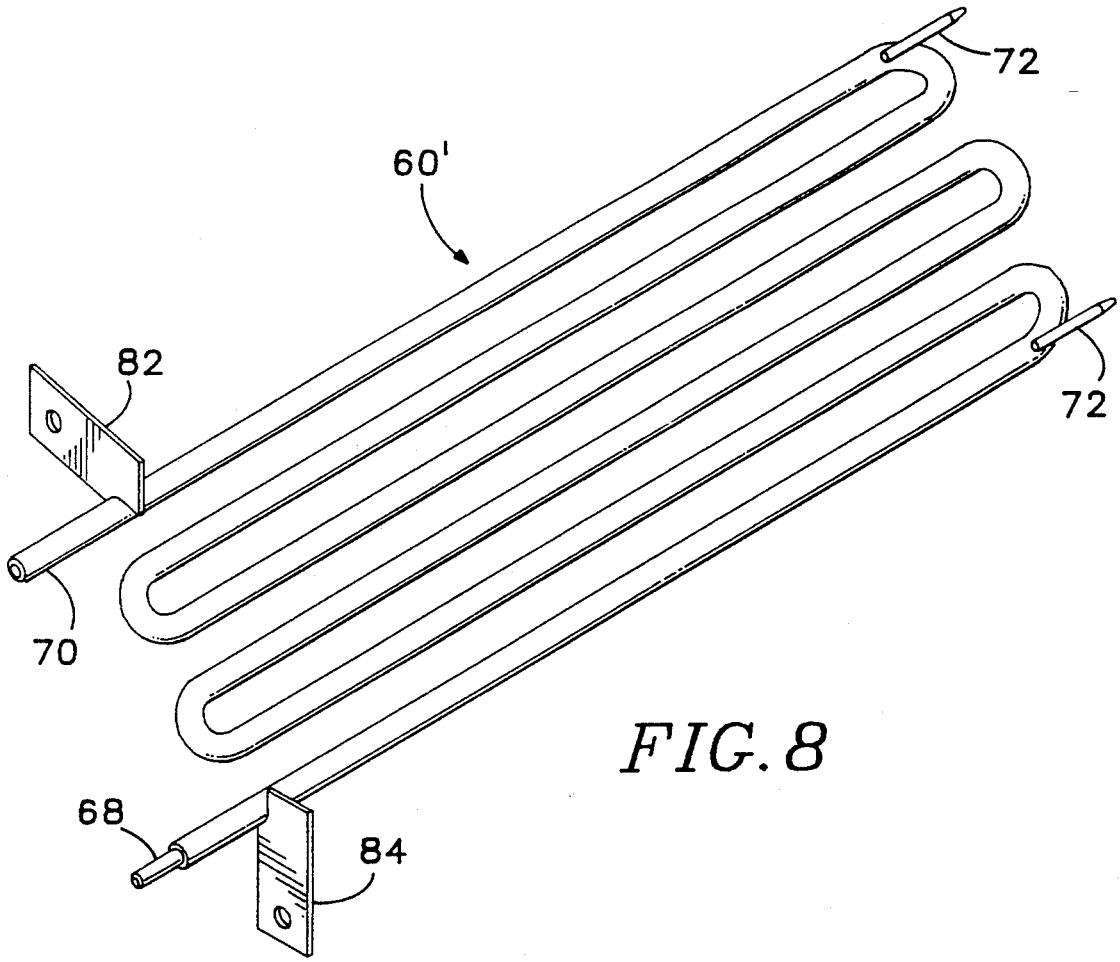
FIG. 8 is a perspective view, similar to FIG. 3, of one of the condenser plates of the condenser shown in FIGS. 6 and 7.

Referring now to the embodiment illustrated in FIGS. 6, 7 and 8, the primary difference over the previously described embodiment resides in the construction and arrangement of the condenser members. As best shown in FIG. 9, the condenser member 60, is formed of tubing bent to serpentine shape to provide a serpentine passageway similar to the passageway 66 in FIG. 3. The condenser member 60, is curved arcuately across its width, and mounted between support rings 74 and 80 by mounting pins 72 and brackets 82 and 84, as in the previously described embodiment. Refrigerant, brine, or other form of coolant is circulated through the tubing from inlet tube 68 to outfeed tube 70.

Since the condenser member 60, has open spaces between the serpentine sections of tubing, optical density is provided by interposing a secondary cylindrical wall 104 between the condenser members 60, and the inner surface of the chamber 10. This secondary wall abuts the inner end of the chamber 10 and is spaced inwardly from the access door 24. Accordingly, vapor from the sublimation vessel 20 must flow the length of the chamber 10, radially inward and outward across the condenser tubing, and then must travel in the reverse direction through the space between the secondary cylinder 104 and the chamber 10, before exiting the vent pipe 96. The cylinder 104 thus provides an alternative form of optical density which insures maximum area contact of the vapors with the surfaces of the serpentine tubing of the condenser member 60'.

It will be apparent to those skilled in the art that various modifications and changes may be made in the number, type, size and arrangement of parts described hereinbefore without departing from the spirit of this invention and the scope of the appended claims.

I claim:

1. A condenser for removing vapor from freeze dryers and other vessels, comprising:

a) an elongated hollow chamber defined by an outer wall having an inner surface, b) a vapor inlet at one end of the chamber arranged for receiving vapor from a freeze dryer or other vessel, c) a vent opening in the outer wall of the chamber arranged for connection to a vacuum system for removing non-condensible vapors from the chamber, and d) a plurality of elongated, hollow condenser members mounted in the chamber about the longitudinal axial center of the chamber in a circumferentially spaced apart and radially offset spaced relation from one another, the radial offset being such that any and all radial lines or planes extending outwardly from the axial center of the chamber between adjacent condenser members intercepts a condenser member before reaching the inner surface of the chamber, whereby to insure contact by vapor flowing from said vapor inlet outwardly through the spaces between adjacent condenser members before reaching the inner surface of the chamber, for collecting condensible vapor on said condenser members during said outward flow of vapor and for collecting any back-streaming products from a vacuum system connected to said vent opening, e) the interior of the hollow condenser members being arranged for the circulation of coolant for cooling the outer surfaces of the members.

2. The condenser of claim 1 wherein each condenser member comprises a pair of metal sheets sealed together in lapped arrangement and configured with a passageway between them for the circulation of a coolant.

3. The condenser of claim 1 wherein each condenser member comprises a length of tubing bent to serpentine shape and providing a passageway for the circulation of a coolant.

4. The condenser of claim 1 wherein the chamber is disposed on a horizontal axis, the vapor inlet is disposed on said horizontal axis, the condenser members are disposed about said horizontal axis, and an access door removably closes the end of the chamber opposite said vapor inlet.

5. The condenser of claim 1 including a vapor distributor mounted in the chamber adjacent said vapor inlet and configured to distribute vapor flow from said vapor inlet onto the surfaces of the condenser members.

6. The condenser of claim 5 wherein the vapor distributor comprises a plurality of concentric rings which flare outwardly in the direction facing the end of the chamber opposite said vapor inlet.

7. The condenser of claim 1 including a vapor distributor mounted in the chamber adjacent said vapor inlet about the longitudinal axis of the chamber and configured to distribute vapor flow from said vapor inlet onto the surfaces of the condenser members.

8. A condenser for removing vapor from freeze dryers and other vessels, comprising:

a) an elongated hollow chamber disposed on a horizontal axis, b) a vapor inlet at one end of the chamber disposed on said horizontal axis, c) an access door removably closing the end of the chamber opposite said vapor inlet, d) a plurality of elongated hollow condenser members mounted in the chamber and disposed about said horizontal axis in a circumferentially spaced apart, radially offset relation, the radial offset being such that radial lines or planes extending outwardly from the axial center of the chamber between adjacent condenser members intercepts a condenser member before reaching the inner surface of the chamber, e) the interior of the hollow condenser members being arranged for the circulation of coolant for cooling the outer surfaces of the plates, f) a vent opening in the chamber for removing non-condensible vapors from the chamber, g) a delivery tube in the chamber extending along the longitudinal axis of the chamber, and a plurality of fluid pressure nozzles on the delivery tube communicating with the interior of the tube, the tube having means for selective communication with sources of cleansing fluid and steam for cleaning, defrosting and sterilizing, respectively, the interior surfaces of the chamber and the outer surfaces of the condenser members, and h) a vapor distributor mounted in the chamber on the delivery tube adjacent said vapor inlet and configured to distribute vapor flow onto the surfaces of the condenser members.

9. A condenser for removing vapor from freeze dryers and other vessels, comprising:

a) an elongated hollow chamber, b) a vapor inlet at one end of the chamber, c) a plurality of elongated, hollow condenser members mounted in the chamber about the axial center of the chamber in a circumferentially spaced apart relation.

d) the interior of the hollow condenser members being arranged for the circulation of coolant for cooling the outer surface of the members, e) a vent opening in the chamber for removing non-condensible vapors from the chamber, f) a vapor distributor mounted in the chamber adjacent said vapor inlet about the longitudinal axis of the chamber and configured to distribute vapor flow from said vapor inlet onto the surfaces of the condenser member, and g) adjustment means in the chamber for adjusting the vapor distributor rotationally about the longitudinal axis of the chamber.

10. A condenser for removing vapor from freeze dryers and other vessels, comprising:

a) an elongated hollow chamber, b) a vapor inlet at one end of the chamber, c) a plurality of elongated, hollow condenser members mounted in the chamber about the axial center of the chamber in a circumferentially spaced apart relation, d) the interior of the hollow condenser members being arranged for the circulation of coolant for cooling the outer surfaces of the members, e) a vent opening in the chamber for removing non-condensible vapors from the chamber, f) a delivery tube in the chamber extending along the longitudinal axis of the chamber, and g) a plurality of fluid spray nozzles on the delivery tube communicating with the interior of the tube, the tube having means for selective communication with sources of cleansing fluid and steam for cleaning, defrosting and sterilizing, respectively, the interior surfaces of the chamber and the outer surfaces of the condenser members.

11. The condenser of claim 10 including a vapor distributor mounted in the chamber on the delivery tube adjacent said vapor inlet and configured to distribute vapor flow from said vapor inlet onto the surfaces of the condenser members.

12. The condenser of claim 11 including adjustment means in the chamber for adjusting the vapor distributor rotationally about and longitudinally along the delivery tube relative to the condenser members.

13. A condenser for removing vapor from freeze dryers and other vessels, comprising:

a) an elongated hollow chamber defined by an outer wall having an inner surface, b) a vapor inlet at one end of the chamber arranged for receiving vapor from a freeze dryer or other vessel, c) a vent opening in the outer wall of the chamber arranged for connection to a vacuum system for removing non-condensible vapors from the chamber, d) a plurality of elongated, hollow condenser members mounted in the chamber about the longitudinal axial center of the chamber in a circumferentially spaced apart relation and arranged to insure contact by vapor flowing from said vapor inlet outwardly through the spaces between adjacent condenser members before reaching the inner surface of the chamber, for collecting condensible vapor on said condenser member during said outward flow of vapor and for connected to said vent opening, e) the interior of the hollow condenser members being arranged for the circulation of coolant for cooling the outer surfaces of the members, and f) a secondary cylindrical wall spaced inwardly from the inner surface of the chamber and surrounding the plurality of condenser members, the secondary cylindrical wall being arranged to direct vapor from the vapor inlet across the surfaces of the condenser members to the end of the chamber opposite the vapor inlet and then radially outward into the space between the secondary cylindrical wall and the condenser chamber in the direction toward the vapor inlet.

14. A condenser for removing vapor from freeze dryers and other vessels, comprising:

a) an elongated hollow chamber defined by an outer wall having an inner surface, b) a vapor inlet at one end of the chamber arranged for receiving vapor from a freeze dryer or other vessel, c) a vent opening in the outer wall of the chamber arranged for connection to a vacuum system for removing non-condensible vapors from the chamber, d) a plurality of elongated, hollow condenser members mounted in the chamber about the longitudinal axial center of the chamber in a circumferentially spaced apart relation and arranged to insure contact by vapor flowing from said vapor inlet outwardly through the spaces between adjacent condenser members before reaching the inner surface of the chamber, for collecting condensible vapor on said condenser members during said outward flow of vapor and for collecting any back-streaming products from a vacuum system connected to said vent opening, each condenser member comprising a length of tubing bent to serpentine shape and providing a passageway for the circulation of a coolant, and e) a secondary cylindrical wall spaced inwardly from the inner surface of the chamber and surrounding the plurality of condenser members, the secondary cylindrical wall being arranged to direct vapor from the vapor inlet across the surfaces of the condenser members to the end of the chamber opposite the vapor inlet and then radially outward into the space between the secondary cylindrical wall and the condenser chamber in the direction toward the vapor inlet.

15. A condenser for removing vapor from freeze dryers and other vessels, comprising:

a) an elongated hollow chamber defined by an outer wall having an inner surface, b) a vapor inlet at one end of the chamber arranged for receiving vapor from a freeze dryer or other vessel, c) a vent opening in the outer wall of the chamber arranged for connection to a vacuum system for removing non-condensible vapors from the chamber, d) a plurality of elongated, hollow condenser members mounted in the chamber about the longitudinal axial center of the chamber in a circumferentially spaced apart relation and arranged to insure contact by vapor flowing from said vapor inlet outwardly through the spaces between adjacent condenser members before reaching the inner surface of the chamber, for collecting condensible vapor on said condenser members during said outward flow of vapor and for collecting any backstreaming products from a vacuum system connected to said vent opening, e) the interior of the hollow condenser members being arranged for the circulation of coolant for cooling the outer surfaces of the members, f) a vapor distributor mounted in the chamber adjacent said vapor inlet about the longitudinal axis of the chamber and configured to distribute vapor flow from said vapor inlet onto the surfaces of the condenser members, and g) adjustment means in the chamber for adjusting the vapor distributor along the longitudinal axis of the chamber toward and away from the condenser members.

16. A condenser for removing vapor from freeze dryers and other vessels, comprising:

a) an elongated hollow chamber defined by an outer wall having an inner surface, b) a vapor inlet at one end of the chamber arranged for receiving vapor from a freeze dryer or other vessel, c) a vent opening in the outer wall of the chamber arranged for connection to a vacuum system for removing non-condensible vapors from the chamber, d) a plurality of elongated, hollow condenser members mounted in the chamber about the longitudinal axial center of the chamber in a circumferentially spaced apart relation and arranged to insure contact by vapor flowing from said vapor inlet outwardly through the spaces between adjacent condenser members before reaching the inner surface of the chamber, for collecting condensible vapor on said condenser members during said outward flow of vapor and for collecting any backstreaming products from a vacuum system connected to said vent opening, e) the interior of the hollow condenser members being arranged for the circulation of coolant for cooling the outer surface of the members, f) a vapor distributor mounted in the chamber adjacent said vapor inlet about the longitudinal axis of the chamber and configured to distribute vapor flow from said vapor inlet onto the surfaces of the condenser members, and g) adjustment means in the chamber for adjusting the vapor distributor rotationally about the longitudinal axis of the chamber.

17. A condenser for removing vapor from freeze dryers and other vessels, comprising:

a) an elongated hollow chamber defined by an outer wall having an inner surface, b) a vapor inlet at one end of the chamber arranged for receiving vapor from a freeze dryer or other vessel, c) a vent opening in the outer wall of the chamber arranged for connection to a vacuum system for removing non-condensible vapors from the chamber, d) a plurality of elongated, hollow condenser members mounted in the chamber about the longitudinal axial center of the chamber in a circumferentially spaced apart relation and arranged to insure contact by vapor flowing from said vapor inlet outwardly through the spaces between adjacent condenser members before reaching the inner surface of the chamber, for collecting condensible vapor on said condenser members during said outward flow of vapor and for collecting any backstreaming products from a vacuum system connected to said vent opening, e) the interior of the hollow condenser members being arranged for the circulation of coolant for cooling the outer surfaces of the members, f) a delivery tube in the chamber extending along the longitudinal axis of the chamber, and g) a plurality of fluid spray nozzles on the delivery tube communicating with the interior of the tube, the tube having means for selective communication with sources of cleansing fluid and steam for cleaning, defrosting and sterilizing, respectively, the interior surfaces of the chamber and the outer surfaces of the condenser members.

18. The condenser of claim 17 including a vapor distributor mounted in the chamber on the delivery tube adjacent said vapor inlet and configured to distribute vapor flow from said vapor inlet onto the surfaces of the condenser members.

19. The condenser of claim 18 including adjustment means in the chamber for adjusting the vapor distributor rotationally about and longitudinally along the delivery tube relative to the condenser members.

* * * * *

UNITED STATES PATENT AND TRADEMARK OFFICE

CERTIFICATE OF CORRECTION

PATENT NO. : 5,236,041

DATED : 17 August 1993

INVENTOR(S) : JOHN M. FAY

It is certified that error appears in the above-identified patent and that said Letters Patent is hereby corrected as shown below:

Column 2, line 26, "16" should read --16'--.

Column 4, line 34, "members," should read --member--.

Column 5, line 5, "60" should read --60'--.

Column 5, line 8, "60" should read --60'--.

Column 5, line 14, "60" should read --60'--.

Column 5, line 17, "60" should read --60'--.

Signed and Sealed this

Seventh Day of June, 1994

Bruce Lehman

*Attest:*

BRUCE LEHMAN

*Attesting Officer*

*Commissioner of Patents and Trademarks*